US010987713B2

(12) United States Patent
Bender et al.

(10) Patent No.: US 10,987,713 B2
(45) Date of Patent: Apr. 27, 2021

(54) DEVICE AND METHOD FOR STRAIGHTENING PRESSING OF A FLAT METAL PRODUCT

(71) Applicant: SMS Group GmbH, Duesseldorf (DE)

(72) Inventors: Hans-Juergen Bender, Olpe (DE); Manfred Dingenotto, Ratingen (DE); Peter Schmitz, Ratingen (DE); Guenther Thues, Ratingen (DE); Gerhard Horn, Ratingen (DE); Achim Klein, Kreuztal (DE)

(73) Assignee: SMS GROUP GMBH, Duesseldorf (DE)

( * ) Notice: Subject to any disclaimer, the term of this patent is extended or adjusted under 35 U.S.C. 154(b) by 228 days.

(21) Appl. No.: 15/764,364

(22) PCT Filed: Sep. 27, 2016

(86) PCT No.: PCT/EP2016/072943
§ 371 (c)(1),
(2) Date: Mar. 29, 2018

(87) PCT Pub. No.: WO2017/055258
PCT Pub. Date: Apr. 6, 2017

(65) Prior Publication Data

US 2018/0272403 A1 Sep. 27, 2018

(30) Foreign Application Priority Data

Oct. 2, 2015 (DE) ..... 10 2015 219 127.3

(51) Int. Cl.
*B21D 1/06* (2006.01)
*B21D 1/00* (2006.01)

(52) U.S. Cl.
CPC ..... *B21D 1/06* (2013.01); *B21D 1/00* (2013.01)

(58) Field of Classification Search
CPC . B21D 1/06; B21D 1/00; B21D 1/065; B21D 5/0254; B21D 37/04; B21D 37/08;
(Continued)

(56) References Cited

U.S. PATENT DOCUMENTS 6,408,667 B1 * 6/2002 de Jesus, Jr. ..... B21B 31/103 29/401.1
8,783,082 B2 * 7/2014 Hill ..... B21D 28/36 72/192

(Continued)

FOREIGN PATENT DOCUMENTS

CA 2479420 A1 * 2/2006 ..... B21D 22/08
CN 202684612 1/2013

(Continued)

OTHER PUBLICATIONS

Machine Translation of WO-2015077810-A1, Denkmeier, Publication Year 2015, Total pp. 19. (Year: 2020).*

(Continued)

*Primary Examiner* — Teresa M Ekiert
*Assistant Examiner* — Sarkis A Aktavoukian
(74) *Attorney, Agent, or Firm* — Abelman, Frayne & Schwab

(57) ABSTRACT

A horizontal roll stand includes upper and lower back-up rolls, removable work rolls, a balancing device for supporting the upper work roll, and a vertical adjustment device for the lower back-up roll. The work rolls are removed and a press device for straightening pressing of a flat metal product is inserted into the roll stand. The press device includes opposing upper and lower press frames that are displaceable relative to each other. The upper press frame and the lower press frame have one of a selectively moveable pressing die or opposing selectively moveable table with a trough for immersion of the pressing die to selectively press and flatten defects in the flat metal product. The upper press frame includes carrier elements which contact a balancing device (Continued)

of and for support within the roll stand. The lower press frame has support elements for being supported on stanchions of the roll stand.

15 Claims, 6 Drawing Sheets

(58) Field of Classification Search
CPC ..... B21D 37/10; B21D 37/12; B21D 22/08; B21D 1/02; B21B 31/10; B21B 31/103; B21B 2203/28; B21B 2203/32; B21B 31/08; B30B 15/02
USPC ..... 29/401.1
See application file for complete search history.

(56) References Cited

U.S. PATENT DOCUMENTS

| | | | | |
|---|---|---|---|---|
| 2004/0231398 | A1* | 11/2004 | Bliss | B21D 22/02 72/481.1 |
| 2015/0306648 | A1* | 10/2015 | Abe | B21D 1/05 72/164 |
| 2018/0001361 | A1 | 1/2018 | Denmel | |

FOREIGN PATENT DOCUMENTS

| | | | | |
|---|---|---|---|---|
| CN | 103272946 | | 9/2013 | |
| DE | 1552080 | | 12/1970 | |
| DE | 10163373 | | 2/2003 | |
| DE | 102014101101 | A1 * | 7/2015 | B21B 31/02 |
| EP | 313957 | | 5/1989 | |
| JP | 0768320 | | 3/1995 | |
| RU | 2138354 | | 9/1999 | |
| SU | 795617 | | 1/1981 | |
| SU | 1423215 | | 9/1988 | |
| SU | 1794528 | | 2/1993 | |
| WO | WO-2015077810 | A1 * | 6/2015 | B21D 37/145 |

OTHER PUBLICATIONS

Machine Translation of DE-102014101101-A1, Frobose, Publication Year 2015, Total pp. 16. (Year: 2020).*
Internet print-out, Portalrichtpresse, of German firm S. Dunkes GmbH Machinenfabrik.
Internet print-out, Blechzuschnitte fuer hoechste Anforderungen, Thyssen-Krupp, Sep. 2010, pp. 1-16.

* cited by examiner

DEVICE AND METHOD FOR STRAIGHTENING PRESSING OF A FLAT METAL PRODUCT

RELATED APPLICATIONS

This application is a National phase application of International application PCT/EP2016/072943 filed Sep. 27, 2016 and claiming priority of German application DE 102015219127.3 filed Oct. 2, 2015, both applications are incorporated herein by reference thereto.

FIELD OF THE INVENTION

The invention relates to a device for straightening pressing a flat metal product, to a roll stand, in particular a horizontal roll stand with such a device, and a method of operating such a roll stand.

PRIOR ART

Roll stands, in particular horizontal roll stands for preferably horizontal rolling of flat metal products are known in the state-of-the art since long ago. Usually, e.g., four-high rolling stands with two work and two back-up rolls are used. Traditionally the roll stands are used only for rolling steel or non-ferrous metal along a flat trajectory.

Independent therefrom, devices for straightening, i.e., flat straightening are known. Straightening typically is carried out by rolling straightening or by presses. An example of a portal straightening press is disclosed, e.g., on an internet website of a firm Fa. Dunkens, Kirchheim unter Teck, Germany. Known devices for straightening usually have an upper frame with a pressing die and a lower press frame with a table for supporting a to-be-straighten flat product, with the upper press frame being arranged above the lower press frame and with both press frames displaceable vertically relative to each other.

The drawback of the known state-of-the art consists in that rolling and straightening require two separate stand-alone machines and, thereby, more floor space and higher costs.

DESCRIPTION OF THE INVENTION

The object of the present invention is to provide a device for straightening pressing a flat metal product, a roll stand with such a device, and a method of operating such a roll stand, and which would enable an economical and efficient straightening of the flat product.

This object, with regard to the press device, is achieved by subject matter as set forth in the claims. It is characterized in that the upper press frame has, in the region of both narrow sides, carrier elements which serve as contact points for a balancing device for the narrow roll in the roll stand, and in that the lower press frame has, in the region of the narrow sides, support elements for supporting the press device on the roll stand supports.

The term "flat metal product" means, within the scope of the description, e.g., metal plate or sheet, or metal strip.

The term "balancing device" means not only a stand-alone balance cylinder for the work rolls but also a bending device, in particular, a bending cylinder that performs a balancing function for the work rolls.

The term "table" means basically a plate. The trough in the table or in the plate means, in the simplest case, a recess.

The table with a trough is typically provided on the lower press frame, and the pressing die is provided on the upper press frame, however, a reverse arrangement is also possible.

The inventive device which is also called a straightening cassette is formed as a slide-in module which is pushed into the roll stand instead of work rolls. The roll stand is not only operated in an operational mode "rolling" (with inserted work rolls) but also, alternatively, in an operational mode "straightening pressing" (with an inserted slide-in module instead of the work rolls). In the operational mode "straightening pressing," the hydraulic work cylinder for the back-up rolls is used for providing a greater straightening force which can fundamentally improve straightening, in particular, of thicker sheets.

This alternative operation is particular advantageous for roll stands which because of a smaller year-long planning for production quantity (e.g., for special material), are not used at their full production capacity when operating in the rolling operational mode. Therefore, for economical reasons, they land themselves to the alternative straightening operational mode, which prevents roll stand downtime and provides for economically better use of the roll stand. The inventive device, i.e., the slide-in module for a roll stand is cheaper and occupies less space than a stand-alone (portal) straightening press.

According to a first embodiment, the upper press-frame is supported by support bolts on the lower press frame during assembly and disassembly of the straightening cassette. During a straightening operation, the support bolts are immersed in corresponding bores in the opposite press frame. In this way, an undesirable sidewise displacement of the pressing die during straightening is prevented. The vertical positioning of the upper and lower press frames relative to each other is carried out by the same cylinder that is used for deflection or balancing of work rolls during a rolling operation.

On the narrow side of the straightening cassette, preferably on the narrow side of the lower press frame, a coupling element can be provided for releasably connecting the straightening cassette to a roll exchange device. With the roll exchange device, in particular, a pull-push device, the straightening cassette can quite easily be advanced into or withdrawn from the roll stand, typically on its operational side.

According to the invention, rails which extend in a longitudinal direction of the upper and/or lower press-frame, are provided on the press frames for displacing the pressing die and/or the table which each is formed as a carriage, on the press frames in the longitudinal direction of the press frames. This configuration enables, in an advantages manner, an easy and precise placement of the pressing die above a defect to be corrected or non-flatness of a flat product to be straightened.

The upper press frame is provided, on its narrow side, with an upper drive, preferably, an upper spindle drive for displacing the pressing die-forming or table-forming carriage on the rails of the upper press frame. The lower press frame has, on its narrow side, a lower drive, preferably, a lower spindle drive for displacing the pressing die-forming carriage or the table-forming carriage on the rails of the lower press-frame. Advantageously, the drives are provided on the narrow sides of the press frames which, after the straightening cassette is pushed in the roll stand, adjoin its operational side, where a relatively simple attachment of energy and medium connections can be carried out.

The above-identified object can further be achieved by a roll stand and by a method of operating the roll stand as set forth in the claims. The advantages of these solutions substantially correspond to the advantages discussed above with regard to the inventive press device.

The control device is so formed that it provides for execution of both operational modes, i.e., the "rolling operation" and the "straightening-pressing operation." The operator of the roll stand has a possibility to execute, as needed, any of both operational modes.

Advantageous embodiments of the roll stand and the method form subject matter of dependent claims.

The description is accompanied by six drawing figures, wherein.

Figure 3:
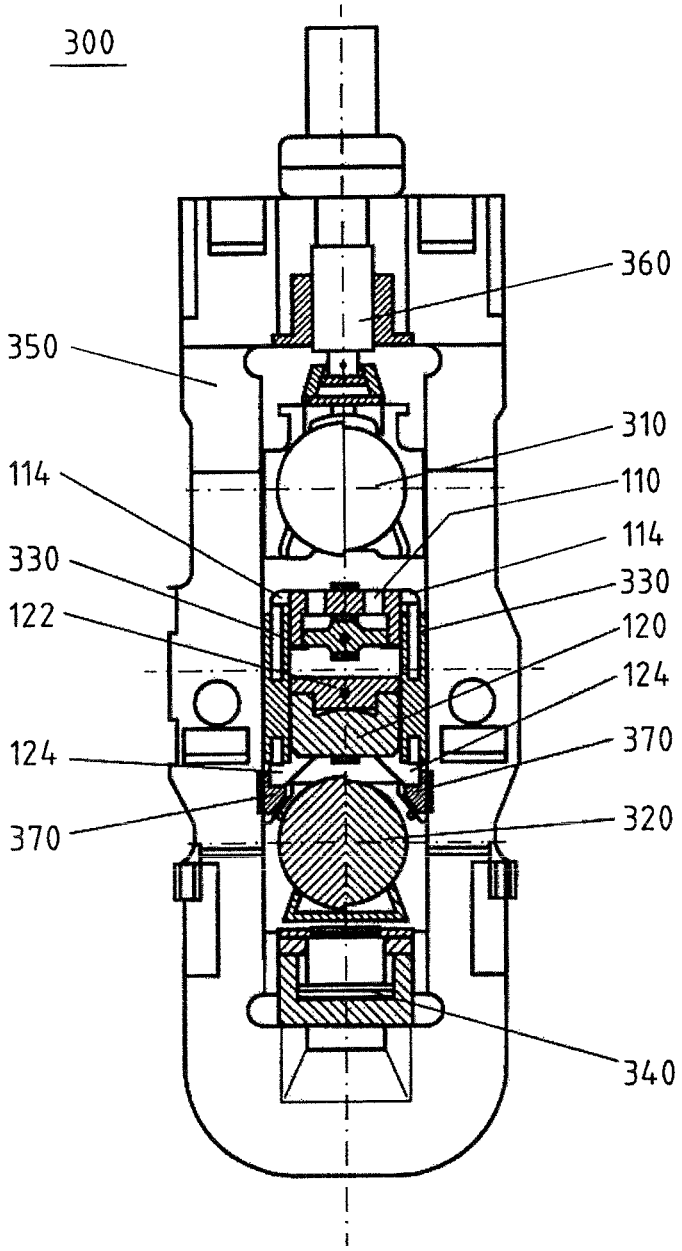
Figure 4:
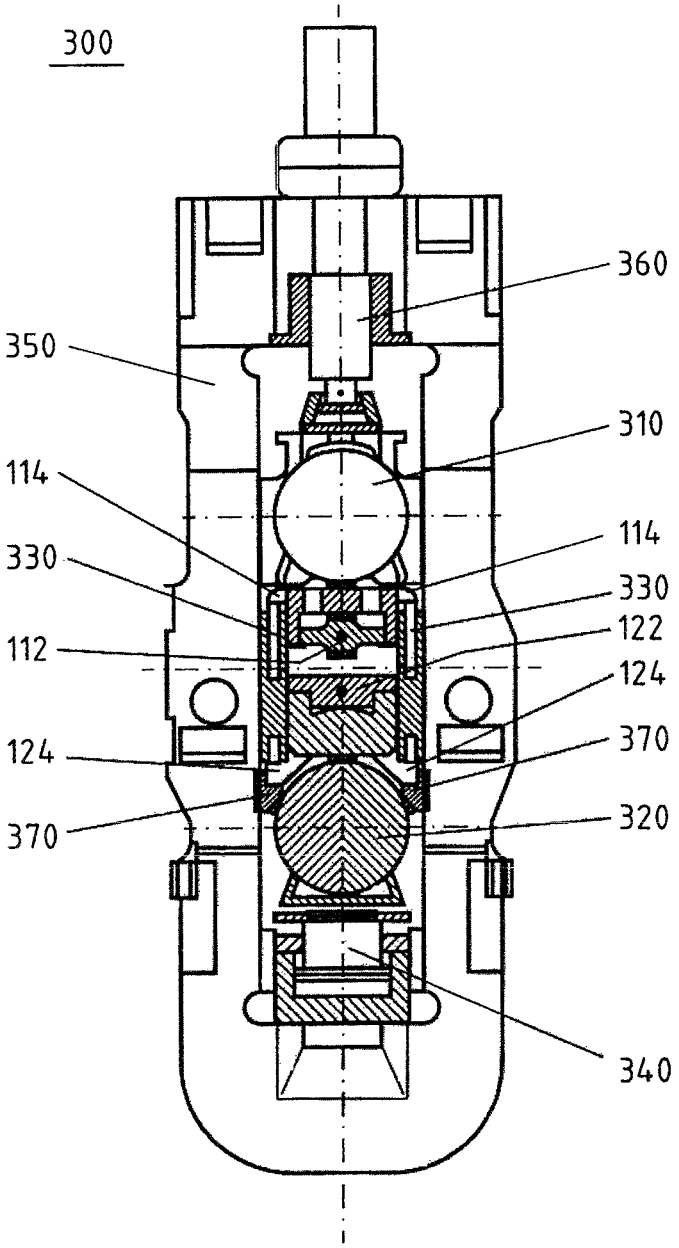
Figure 5:
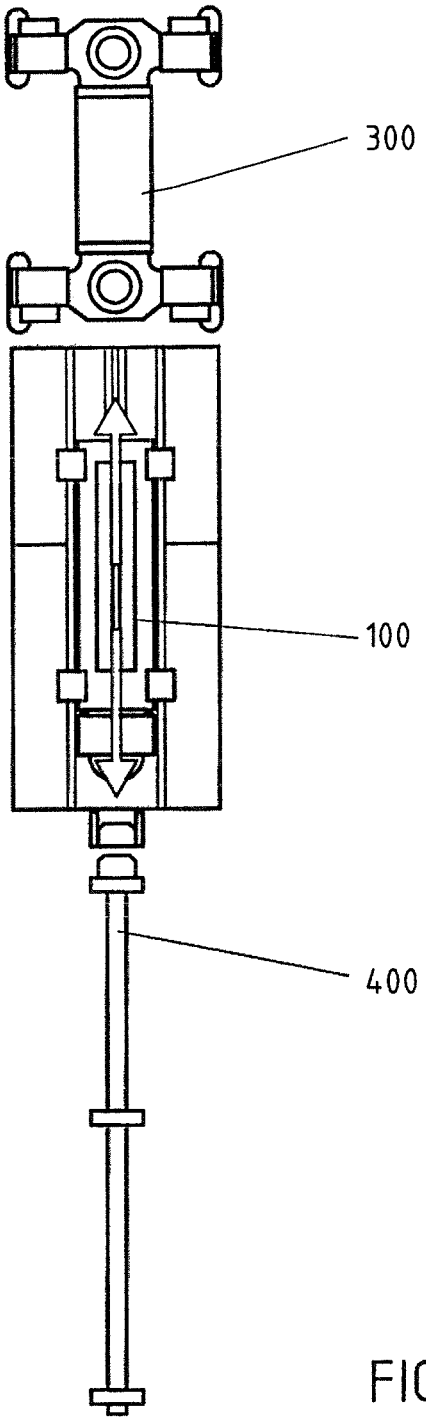
Figure 6:
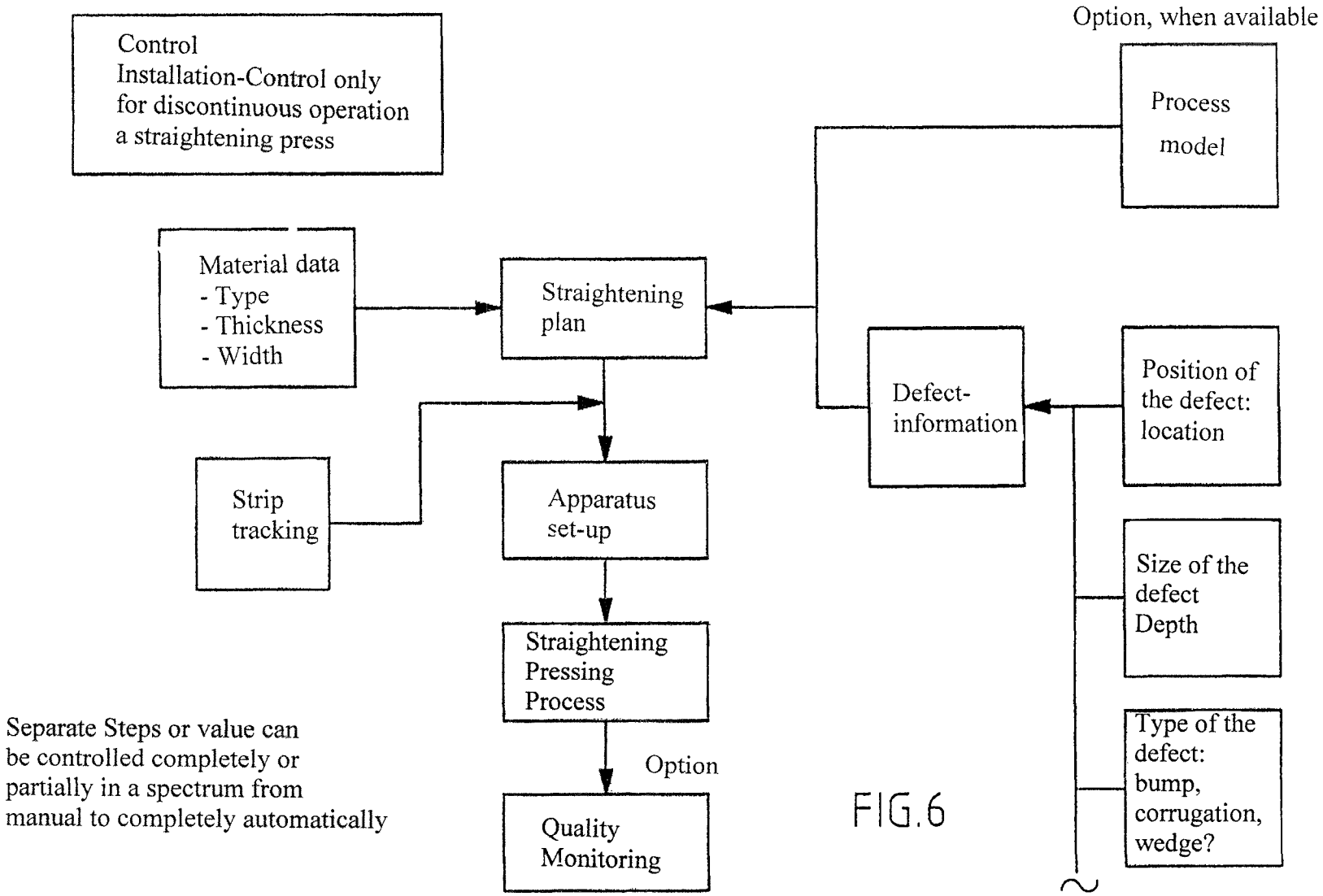

FIG. 3 a four-high roll stand with installed inventive device with displaced upper and lower back-up rolls;

FIG. 4 the roll stand of FIG. 3 in a start-up position for a straightening operation with the upper and lower back-up rolls in a support position for the press-frames;

FIG. 5 is a plan view of the roll stand with the pull-out device and a roll exchange device; and FIG. 6 is a flow diagram that shows the steps for preparation of the straightening operation.

The invention will be described in details below by way of exemplary embodiments with reference to the above-referred figures. In the figures, the same technical elements are designated with the same reference numerals.

Figure 1:
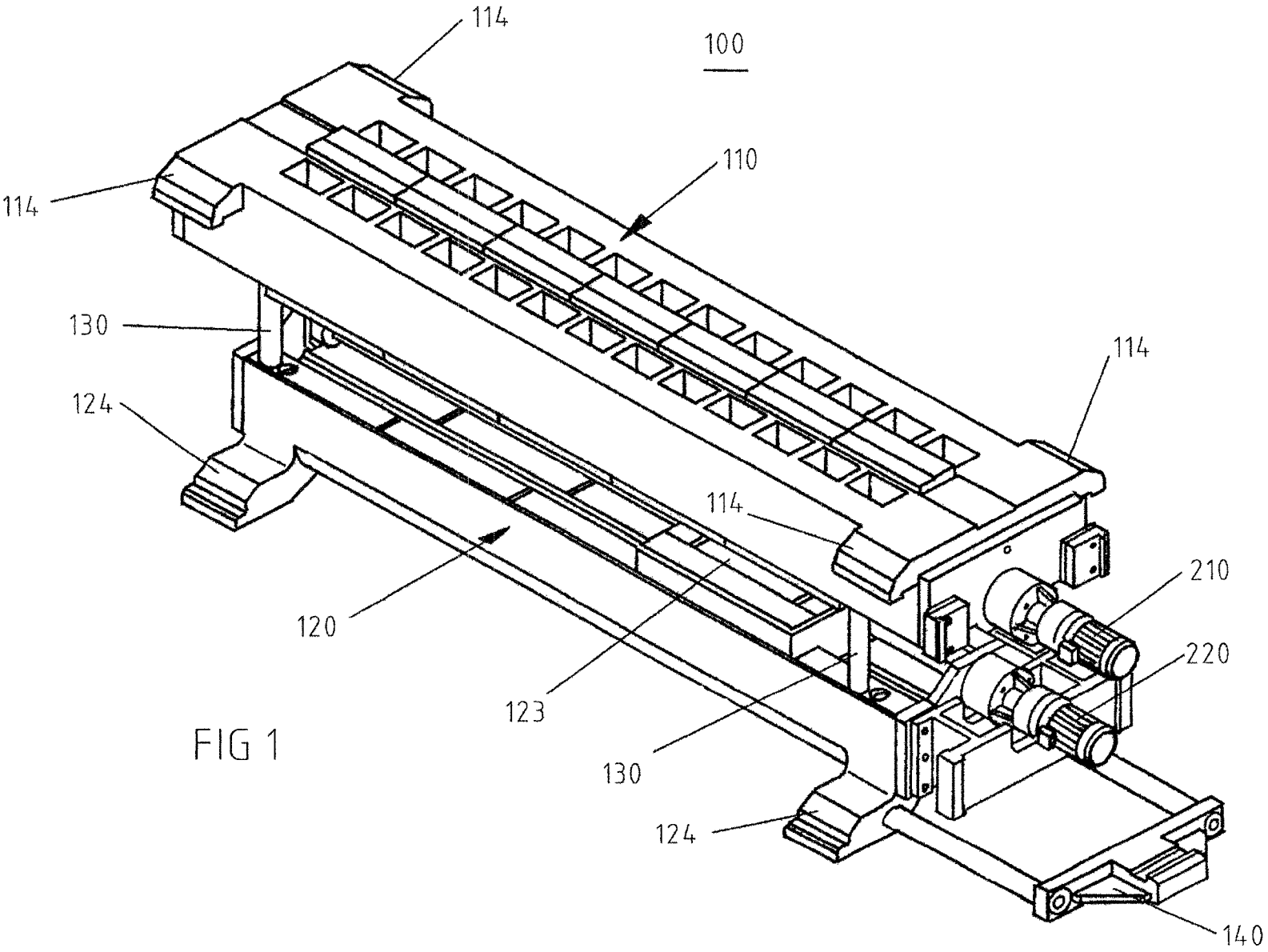
FIG. 1 is a perspective view of the inventive device or the straightening cassette according to the present invention.

FIG. 1 shows a perspective view of the inventive device 100, also called a straightening cassette, for straightening pressing a metallic flat product, e.g., a sheet in a roll stand. The device 100 has an upper press frame 110 and a lower press frame 120. FIG. 1 shows the straightening cassette in a dismantled condition, i.e., in a non-mounted condition in the roll stand. In this condition, the upper press frame 110 is offset in a longitudinal direction with respect to the lower press frame 120. The upper press frame 110 is typically supported on the lower press frame 120 by support bolts 130. The support bolts 130 are arranged in the area of narrow sides of the press frames 110, 120 and, preferably, are fixedly secured on the upper press frame 110.

The upper press frame 110 has, in the region of its narrow sides, carrier elements 114 which during the installation in the roll stand, serve as contact points for a balancing device, e.g., a balancing cylinder for the upper work rolls in the roll stand. Similarly, the lower press frame 120 has, in the region of its narrow sides, support elements 124 which serve upon installation in the roll stand for support on the roll stand stanchions 350. More precisely, the support elements 124 are formed as slide elements or rollers which during installation of the straightening cassette in the roll stand or dismantling of the straightening cassette from the roll stand, slide or roll over rails 370 provided in the roll stand for mounting or dismounting of the work rolls; see FIG. 3.

For installation in the roll stand, the longitudinal extent of the upper and lower press frames corresponds, at least approximately, to the width of the roll stand from the drive side to the operational side.

As further shown in FIG. 1, a coupling element 140 is provided on the end side of the device 100 for releasably connecting the device or straightening cassette to a pull-push device 400. The pull-push device 400 serves for moving the straightening cassette 100 with the upper and lower press frames into and out of the roll stand region. The pull-push device is actually a (roll) exchange device, in particular, an exchange locomotive; see FIG. 5.

Figure 2:
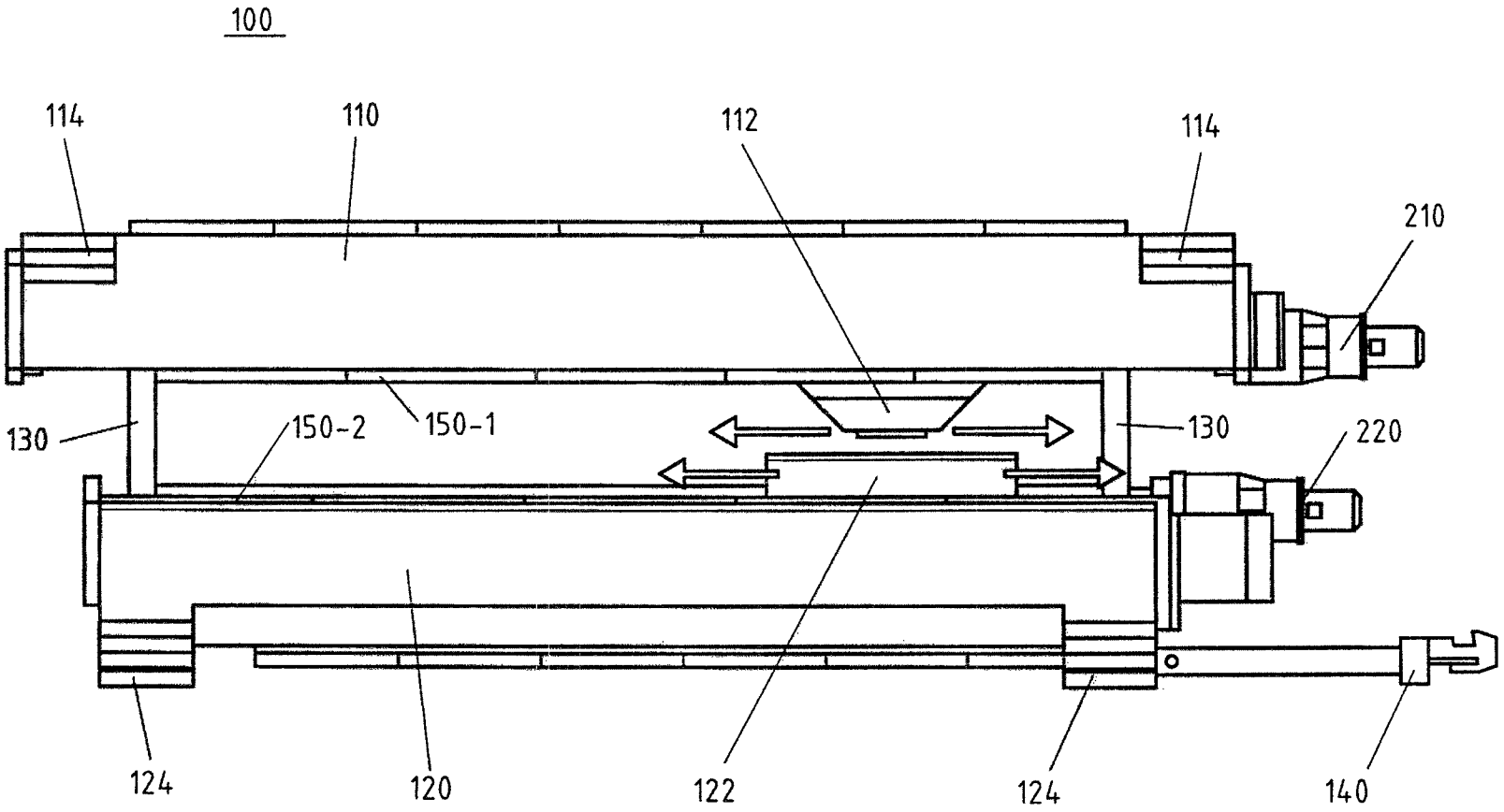
FIG. 2 is a longitudinal view of the device.

FIG. 2 shows a longitudinal cross-sectional view of the inventive device 100. FIG. 2 likewise shows the straightening cassette in a dismantled condition, with the upper and lower press frames offset relative to each other, as described with reference to FIG. 1. On the upper press-frame 110, preferably on its side adjacent to the lower press frame 120, rails 150-1 which extend in the longitudinal direction of upper press frame, are provided.

A pressing die 112 that is formed as a carriage, is displaceably arranged on the rails 150-1. On the lower press frame 120, preferably on its upper side adjacent to the upper press frame 110, likewise rails 150-2 which extend in the longitudinal direction of the lower press frame, are provided. A table 122 for supporting the to-be straighten flat product and which likewise formed as a carriage, is displaceably arranged on the rails 150-2, see the horizontal arrow in FIG. 2. The table 122 has, as shown in FIG. 1, a trough 123 forming space into which the material of the flat product can be pressed into or be overstretched.

On one of its end sides, the upper press frame 110 has an upper drive device 210 for displacing the formed as a carriage, pressing die 112 on the rails 150-1 of the upper press frame. Preferably, on the similar end side, the lower press frame 120 has a lower drive device 220 for displacing the formed as a carriage, table 122. The drive devices 210, 220 are preferably formed on the same end sides of the press frames 110, 120 and which lie, during the installation of the device 100 in the roll stand, on the operational side of the roll stand. With the drive devices 210, 220 which, preferably, formed as spindle drives, the table 122 and the pressing die 112 can be suitably positioned, independently from each other by being displaced along the rails 150-1, 150-2. Suitably positioned means that the table 122 and the pressing die 112 are so displaced relative to each other that the pressing die 112 is precisely positioned in the region of the to-be-straighten non-flatness of the flat product.

FIG. 3 shows that an inventive roll stand 300, here, e.g., a four-high roll stand 300 with two back-up rolls 310, 320 and, normally, with two work rolls, not shown in FIG. 3, as being dismantled. The upper back-up roll 310 and the lower back-up roll 320 are both displaced upward and downward, respectively. Instead of work rolls, the inventive device 100, i.e., the straightening cassette, is installed in the roll stand. The drawing shows that the lower press frame 120 with its support elements 124 rests on rails 370 for changing the work rolls. The upper press frame 110 is releasably supported with its carrier elements 114 on the balancing device 330 or is supported thereby in vertical direction. The balancing device 330 usually serves, when the roll stand is operated in operational mode "rolling," for balancing, i.e., for compensating the weight force of the upper work roll. FIG. 3 shows the roll stand 300 equipped with the straightening cassette for the inventive operational mode straightening pressing.

In this case, as discussed, the balancing device serves for carrying, i.e., for compensating the weight force of the upper press frame 110. In FIG. 3, the displaced upwardly back-up roll 310 has no contact with the upper press frame 110, and the lower back-up roll 320 likewise has no contact with the lower press frame 120, thus, FIG. 3 shows the roll stand in a ready-for-use condition.

FIG. 4 likewise shows the roll stand 300 with the installed straightening cassette 100. In distinction from FIG. 3, here, the lower back-up roll 320 is advanced against the lower press frame 120 by a vertical adjusting, device 340. In this way, the lower press frame is lifted at least slightly from the rails 370 for changing work rolls and applies straightening forces acting in the vertical direction during the straightening operation. Likewise, the upper back-up roll 310 is advanced in a predetermined stop position for the upper press frame 110 by a mechanical adjusting device 360. Otherwise, the upper press frame 110 is positioned in the stop position against the upper back-up roll 310 force-lockingly and without a clearance by the balancing device 330. The described and shown in FIG. 4 position defines a start-up condition of the roll stand for the straightening operation. A free space into which a to-be-straightened flat product can be advanced can be seen between the pressing die 112 and the table 122.

FIG. 5 has been discussed above in connection with the description of FIG. 1.

Below, the method of operating the roll stand 300 in the inventive operational mode "straightening pressing" will be described in detail. At that, it should be again emphasized that the operational mode "straightening pressing" of the roll stand as an alternative to the operational mode "rolling" is freely selectable. Because the operational mode "rolling" is known since long ago, it is not described in the description above.

For preparation for installation of the straightening cassette 100 in the roll stand, the upper and lower back-up rolls are displaced, and the work rolls are removed from the roll stand over the rails 370. The straightening cassette is located outside of the roll stand. The upper press frame 110 is typically supported by the support bolts 130 on the lower press frame 120 offset in the longitudinal direction relative thereto and projecting toward the drive side of the roll stands as shown in FIGS. 1 and 2. The installation of the straightening cassette 100 in the roll stand includes the following steps:

- Advancing the straightening cassette on the rails 370 for the work rolls exchange into the roll stand by the pull-push device 400 until it stops inside against the drive side stanchions 350 of the roll stand 300:
- Closing the upper work roll locking means;
- Lifting the balancing device 330 for supporting the upper press frame 110 on its carrier elements 114;
- Further advancing the straightening cassette with the work roll exchange device in the roll stand until the lower press frame 120 rests with its support elements 124 on the drive side stanchions of the roll stand 300; and
- Closing the lower work roll locking means.

At that, the lower press frame 120 is displaced relative to the upper press frame 110 that was blocked by the drive side of the roll stand upon its horizontal displacement. The lower and upper press frames are not offset relative to each other anymore but also are symmetrically arranged opposite each other. Simultaneously, in the opposite position, the support bolts 130 are displaced in complementary openings in the oppositely located frame. In the opposite position against opening, the support bolts do not carry any support function for the upper press frame; the support function is taken over by the balancing device for the work rolls. After installation of the straightening cassette in the roll stand, both the roll stand and the straightening cassette are brought into the start-up condition for "straightening operation," as shown in FIG. 4. To this end, the following steps are executed:

- Displacing the upper back-up roll 310 downwardly in an upper stop position for the upper press frame 110;
- Placing the upper press frame against the upper stop position with a balancing device 330;
- Lifting the lower back-up roll 320 to a lower stop position for the lower press frame and displacing the lower press frame 120 in clearance-free contact with the lower back-up roll in the lower stop position in which the lower press frame does not have any contact anymore with the rails 370 for work roll exchange.

In the start-up position for the operational mode "straightening pressing, between the pressing die 112 and the table 122, a free space into which the to be-straightened flat product can be advanced, still remains, as was described above with reference to FIG. 4.

The operational mode "straightening pressing" itself has, starting from the start-up condition of the roll stand the straightening pressing operation, has the following steps:

- Advancing a flat product in the roll stand into the free space between the pressing die 112 and the table 122;
- Positioning the to-be-straightened flat product with regard to the table of the lower press frame 120 in such a way that the to-be-eliminated non-flatness is lifted upward to the upper press frame 110 and is located between the two press frames;
- Positioning the table 122 with the flat product and/or the pressing die 112 by a traverse movement of the pressing die or the table so that the pressing die is located above the non-flatness; and
- Straightening the flat product by lifting the lower back-up roll with the lower press frame supported thereby with, preferably, hydraulic vertical adjusting device for the back-up roll for pressing the flat product located on the table of the lower press frame against the pressing die 112 on the upper press frame for deleting the non-flatness of the flat product.

The above-described straightening of the flat product by pressing the flat product from below is selected when the vertical adjusting device is located in the roll stand below and is available for pressing the lower back-roll 320 upward. Generally, the position of the pressing die and the trough can be changed in comparison with the embodiment according to FIGS. through 4, so that in this case the to-be-deleted non-flatness extends downwardly. In this case, the pressing die presses from below against the above-located table with the trough.

Before the start of the straightening pressing operation, a plan of straightening pressing of the flat product can be established taking into consideration the flat product data, such as property of the material, its thickness and width and taking into consideration the information about the non-flatness, location of the defect, size and depth and the type of the defect, and optionally by providing a process model.

The to-be-straightened non-flatness in the flat product can be, e.g., evaluated with a scanner automatically by providing a picture. The information about the non-flatness can be produced at least partially automatically by evaluating the scanned picture.

In order to insure good straightening results, respective actual position of the flat product can be regularly monitored and, in case of deviation from a respective set position, is corrected.

After execution of the straightening operation, the result of the straightening pressing process can be monitored and compared with a predetermined set result. I.e., the result can be checked as to what extent the initial non-flatness in the flat product is already eliminated. At a determined deficient quality of the straightening result, i.e., an unsatisfactory elimination of non-flatness, the straightening operation can be repeated. After the straightening operation is completed, i.e., after elimination of non-flatness, the back-up rolls 310, 320 are displaced, and the press frames are removed. For dismantling of the straightening cassette, the above-described steps for installation of the straightening cassette in the roll stand are executed in reverse order.

All of the process steps can be carried out manually or be controlled automatically. It is preferable, however, that at least some of the steps are executed automatically.

LIST OF REFERENCE NUMERALS

100 Device
110 Upper press frame
112 Pressing die
114 Carrier elements of the upper press frame
120 Lower press frame
122 Table
123 Trough
124 Support elements of the lower press frame
130 Support bolts
140 Coupling element
150-1 Rails on the upper press frame
150-2 Rails on the lower press frame
210 Upper drive
220 Lower drive
300 Rolling stand
310 Upper back-up roll
320 Lower back-up roll
330 Balancing device
340 Vertical adjusting device for the lower back-up roll
350 Stanchions of the roll stand
360 Vertical adjusting means for the upper back-up roll
370 Rails for work rolls in the roll stand
400 Pull-push device or roll exchange locomotive

The invention claimed is:

1. A roll stand, comprising:

upper and lower back-up rolls mounted between opposing stanchions of the roll stand;

a pair of removable work rolls including an upper work roll and a lower work roll removably insertable between the opposing stanchions;

a balancing device for supporting the upper work roll; a press device; and a vertical adjustment device for the lower back-up roll, wherein the roll stand is configured for removal of the pair of work rolls and insertion of the press device for a straightening-pressing operation of a flat metal product, the press device comprising an upper press frame and an opposing lower press frame, the upper press frame and the lower press frame each having one of a pressing die and a table with a trough for immersion of the pressing die, respectively, the upper press frame and the lower press frame being arranged opposite and displaceable relative to each other; and wherein the upper press frame includes carrier elements which, in a first arrangement of the press device with the upper work roll removed from the roll stand, form contact points with the balancing device for the upper work roll of the roll stand, and the lower press frame includes support elements which, in the first arrangement with the lower work roll removed from the roll stand, are supported on the opposing stanchions of the roll stand.

2. The roll stand according to claim 1, wherein in a second arrangement of the press device and during an initial position for the straightening-pressing operation, the lower press frame is supported against the lower back-up roll and the upper press frame is supported with the carrier elements thereof against the balancing device and is adjusted by the balancing device against the upper back-up roll.

3. The roll stand according to claim 1, further comprising a controller for selectively controlling operation of the roll stand in an operational rolling mode of a roll stock or the straightening-pressing operation.

4. The roll stand according to claim 1, wherein the roll stand further includes rails for changing the work rolls, and wherein the support elements of the lower press frame are formed as slides or rollers for sliding or rolling on the rails for changing the work rolls.

5. The roll stand according to claim 1, wherein the vertical adjustment device is a hydraulic vertical adjustment device.

6. A method of performing a straightening-pressing operation of a flat metal product with a roll stand, the roll stand including stanchions which support upper and lower back-up rolls; removable upper and lower work rolls; a balancing device for supporting the upper work roll; and a vertical adjustment device for the lower back-up roll, the method comprising:

removing the upper and lower work rolls from the roll stand;

installing a press device for performing the straightening-pressing operation on the flat metal product in the roll stand, the press device including an upper press frame and an opposing lower press frame, the upper press frame and the lower press frame each having one of a pressing die and a table with a trough for immersion of the pressing die, respectively; the upper press frame and the lower press frame arranged opposite and displaceable relative to each other such that the pressing die and table are configured for movement and alignment to face opposite each other; wherein the upper press frame has carrier elements which form contact points with the balancing device of the roll stand, the lower press frame having support elements for being supported on the stanchions of the roll stand, wherein the method further comprises the steps of:

advancing and positioning the flat metal product in the rolling stand between the upper and lower frames of the press device;

positioning and aligning the table and the pressing die relative to a non-flatness defect of the flat metal product by a transverse movement of at least one of the pressing die and the table such that one of the pressing die or the table are located above the non-flatness defect, and straightening the flat metal product by lifting the lower back-up roll, together with the press device supported thereon, with the vertical adjustment device of the lower back-up roll and thereby, pressing the flat metal product supported on the lower press frame from below against the pressing die or the table located on the upper frame for eliminating the non-flatness defect of the flat metal product.

7. The method according to claim 6, wherein after said pressing of the flat metal product, the method further comprises the step of displacing both back-up rolls and the upper and lower press frames in an open position.

8. The method according to claim 6, wherein said installing step includes:

displacing the upper and lower back-up rolls of the roll stand in opposite direction away from each other, removing the upper and lower work rolls from the roll stand, displacing the upper press frame from the balancing device advancing the press device with a roll exchange device over rails for changing the work rolls until the upper press frame is stopped inside against a drive-side of the stanchions of the roll stand;

closing an upper work roll locking device;

lifting the balancing device of the upper work roll for supporting the upper press frame on the carrier elements thereof;

further advancing the press device with a push-pull device in the roll stand until the lower press frame is stopped inside against the drive-side of the stanchions, inserting one or more support bolts into opposite complementary openings formed in the upper and lower press frames;

closing a lower work roll locking device; and setting an initial position between the upper and lower press frames for the straightening-pressing operation.

9. The method according to claim 8, wherein the setting of the initial position step includes:

displacing the upper back-up roll downwardly in an upper stop position of the upper press frame;

clearance-free positioning of the upper back-up roll in the upper stop position with the balancing device; and lifting the lower back-up roll in a lower stop position of the lower press frame with the lower back-up roll abutting the lower press frame in the lower stop position.

10. The method according to claim 6, wherein prior to the step of advancing and positioning the flat metal product in the rolling stand, the method includes the step of preparing a plan of the straightening-pressing operation of the flat metal product by determining a type of material, thickness and width of the flat metal product, and determining information of position, size, depth, and type of the non-flatness defect in the flat metal product.

11. The method according to claim 10, wherein the determining the information of the non-flatness defect comprises the step of automatically capturing and scanning pictures of the non flatness defect, and evaluating the scanned pictures to automatically provide at least a portion of the information associated with the non-flatness defect.

12. The method according to claim 10, wherein the positioning and aligning step comprises:

monitoring an actual position of the non-flatness defect of the flat metal product in the roll stand, detecting a deviation of at least one of the pressing die and table from a planned set position of the non-flatness defect in the roll stand, and repositioning the at least one of the pressing die and table over the flat metal product in the rolling stand in accordance with the planned set position.

13. The method according to claim 6, further comprising monitoring and comparing results of the straightening-pressing operation with a predetermined set of results, determining if the monitored results satisfy a predetermined degree of quality, and repeating the straightening-pressing operation until the monitored results satisfy the predetermined degree of quality.

14. The method according to claim 6, wherein the straightening step further comprises performing the straightening-pressing operation manually or at least partially automatically.

15. The method according to claim 6, wherein the vertical adjustment device is a hydraulic vertical adjustment device.

* * * * *